United States Patent [19]

Prümm

[11] 4,234,072

[45] Nov. 18, 1980

[54] ELECTRONIC COIN TESTER WITH CONTROLLED MECHANICAL TESTING DEVICE

[76] Inventor: Georg J. Prümm, Koelner Strasse 235, 5275 Bergneustadt, Fed. Rep. of Germany

[21] Appl. No.: 965,302

[22] Filed: Dec. 1, 1978

[30] Foreign Application Priority Data

| | | | |
|---|---|---|---|
| Dec. 2, 1977 | [DE] | Fed. Rep. of Germany | 2753691 |
| Mar. 25, 1978 | [DE] | Fed. Rep. of Germany | 2813061 |
| Apr. 3, 1978 | [DE] | Fed. Rep. of Germany | 2814258 |

[51] Int. Cl.[3] ..... G07F 3/02

[52] U.S. Cl. ..... 194/100 A

[58] Field of Search ..... 194/1 C, 103, 100 A, 194/100 R, 99; 133/3 C, 3 D, 3 R

[56] References Cited

U.S. PATENT DOCUMENTS

| | | | |
|---|---|---|---|
| 3,242,932 | 3/1966 | Becker | 133/3 R |
| 4,106,610 | 8/1978 | Heiman | 194/100 A |

*Primary Examiner*—Stanley H. Tollberg
*Attorney, Agent, or Firm*—Richard P. Matthews

[57] ABSTRACT

Coin testing apparatus for testing coins of plural denominations which initially tests each coin electronically by means of a probe. According to the denomination of coin indicated by the electronic tests, a mechanically operating sorter which corresponds to this denomination is energized to check that the mechanical properties of the coin correspond to this denomination. Thereafter a counter is operated. Whenever a bad or non-genuine coin is detected, the movement of all coins is blocked so that even succeeding good or genuine coins will not be processed until the bad coin is removed. Alternatively, coins which fail the electronic test are rejected by falling past a member which only moves into position to intercept or guide coins which have passed the electronic test. Timing stages delay the energization of a corresponding mechanical sorter for a timed period after the electronic test to allow time for a good coin to reach the mechanical sorter and for a preceding bad coin to pass by.

9 Claims, 13 Drawing Figures

ELECTRONIC COIN TESTER WITH CONTROLLED MECHANICAL TESTING DEVICE

The invention relates to a novel coin testing apparatus with improved protection against false coins.

In the electronic coin testing devices which have become known, two systems are used: the one system comprises an electronic testing device, a subsequent good/bad gate, and a following sorting device for the good coins in which the latter are sorted with respect to their dimensions. The second system consists of an electronic testing device and a multiple gate controlled by the latter which guides false coins into a return delivery duct and guides good coins, depending upon the sort detected, into the individual sorting ducts by means of appropriately controlled gate position.

In both systems the examination of the coin is effected by the electronic testing device only. When a coin has been detected to be good on the basis of the properties of its material, or other criteria, it is guided into a sorting device, without its diameter being controlled once more in respect of the preceding examination result.

Two severe disadvantages and possibilities to outwit such known coin testing devices result therefrom.

The one defect resides in that it is admittedly difficult to imitate a genuine coin of defined dimensions by a disc of the same dimensions but different material, but that the electronic measuring result for a certain coin can be obtained relatively easily when metal discs of different material and different dimensions are used. It is obvious that this possibility increases with the number of coin types to be examined by a coin tester. For example, in a coin tester for four kinds of coins four defined dimensions are available altogether for outwitting attempts; of these only one is "difficult", whereas three further ones offer relatively good possibilities for outwitting with discs of different material.

A further defect resides in that electronic coin testers with reasonable expenditure can always detect only the material properties of coins, but not non-conductive materials. Accordingly they can easily be outwitted in that the diameter of genuine coins of low value and small diameter is enlarged by means of a plastic ring slipped thereover. Coins prepared in this way are admittedly evaluated at the low value derived from the small original diameter, but in the following sorting device they travel into the sorting ducts for larger coins of higher value, in consequence of a falsified diameter. At a later instant of time they are returned as such coins in the form of change, and thus the user of the automatic apparatus suffers a loss.

In some apparatus, only the sorted coins produce counting pulses or the like for the functioning of the apparatus. In these cases for the proprietor of the automatic apparatus additionally suffers a loss, because a coin falsified in this way with a correspondingly higher value initiates the delivery of goods or the like.

It is an object of the invention to avoid the defects referred to, to propose practical usable constructions and circuits for an electronic coin tester in accordance with this invention, as well as to indicate new solutions of the problem which have not become known heretofore and which extend to an advantageous construction of the blocking elements produced hereinafter, the combination of sorting balances and sorting sliders within a single sorting section which in this way may guide two or more coin types into a single acceptance path, an automatic enforcement or the minimum spacing of the coins to be examined, or circuits, respectively, which exclude functioning failures when the succession of coins is too rapid.

According to the invention, it is proposed as a first step to construct an electronic measuring and evaluating circuit of any kind monitoring a guide duct for coins (circuits of this type have become known in numerous constructional forms) in such a manner that it produces a characteristic output signal of defined duration for each coin detected to be good, to combine it with a mechanically operating sorting device which is arranged underneath the guide duct, examines the dimensions of the coins and is of unlockable construction, the sorting device having an individual sorting section for every-one or more-type of coins, which are controllable and which are rendered functionally operative by means of the characteristic output signals of the measuring and evaluating circuit for a period of time of such length that a coin recognized by the measuring and evaluating circuit can pass through the sorting section prepared for it, within this period of time with normal unimpeded forward movement.

According to the invention it is further proposed to dispose switches or the like for the production of counting pulses only after the individual sorting sections.

Owing to the arrangement according to the invention it is ensured that coins, in accordance with their electronically measured properties, release only the sorting section for a sufficiently dimensioned period of time, which section corresponds to their normal diameter, and that they can generate counting pulses or the like only after they have travelled through the sorting section determined for them. Because of the incorrect diameter, coins with falsified diameters are guided to sorting sectors not ready for operation where for example they block and are guided in a known manner into the return delivery duct by means of a manual key, or from which they drop out because these sorting sections had not been prepared for acceptance by a correct examination result.

The invention will be described by way of example with reference to the accompanying drawings, in which the references refer to like parts and in which:

FIG. 1 is a front elevational view, with portions broken away, illustrating one embodiment of the present invention;

FIGS. 2*a* and 2*b* are fragmentary front and side elevational views, respectively, illustrating another embodiment of the present invention;

FIGS. 3*a* and 3*b* are fragmentary side elevational views illustrating two different positions of another embodiment of the present invention;

Figure 1:
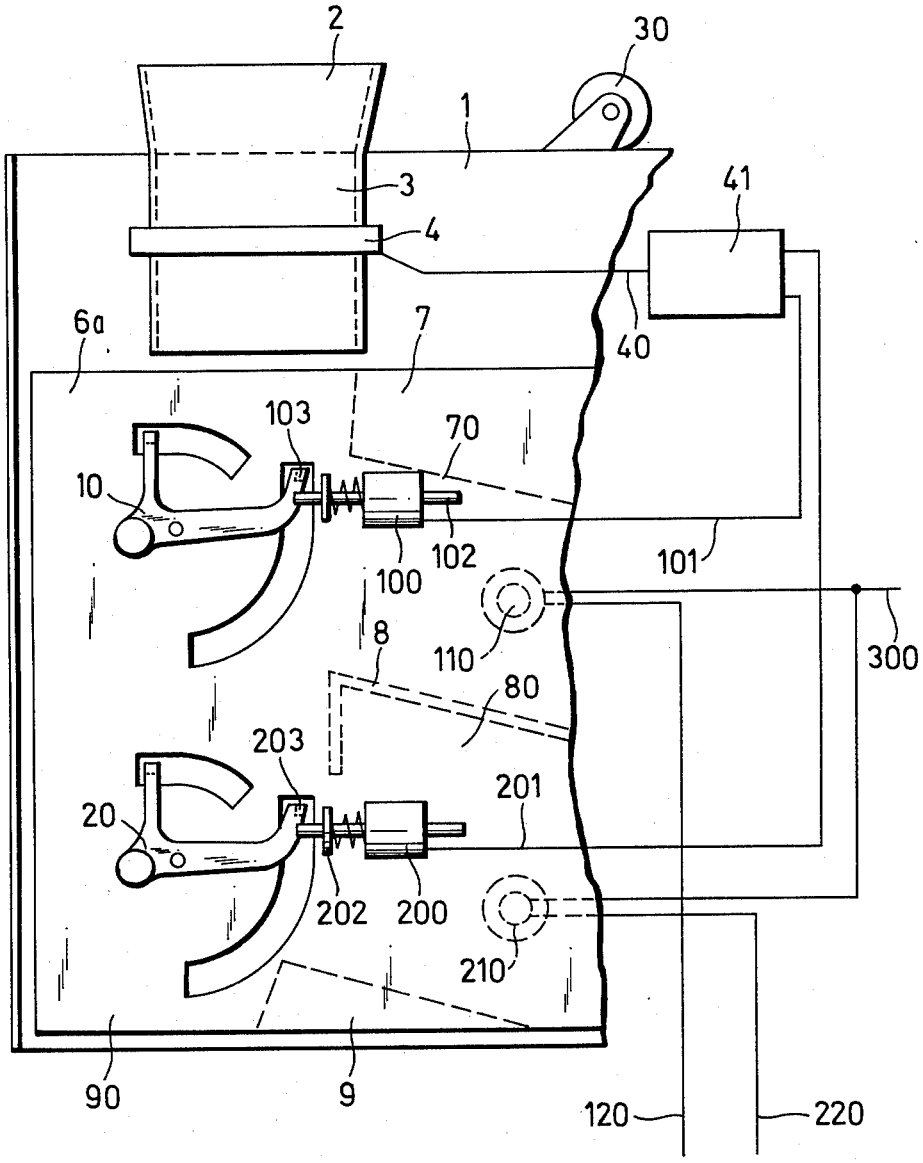

FIG. 1 shows a base plate 1 of a coin testing apparatus, an inserter hopper 2 for a drop shaft 3, and a measuring probe 4. The latter is connected to an electronic measuring and evaluating circuit 41 of known kind by a lead 40. A spacer plate 6*a* is rotatable by means of an unlocking lever 30 about an axis not illustrated and is arranged parallel to the base plate 1 in a known manner at a spacing of slightly more than coin thickness; together with the spacers members 7, 8 and 9 it forms the return delivery duct 90 and the sorting ducts 70 and 80.

The sorting weighers 10 and 20 or known construction are blocked in their normal or rest positions. A coin not recognized as good—when the diameter is too small—either drops directly into the return delivery duct 90, or is intercepted and retained by one of the sorting weighers. Upon actuation of the unlocking lever 30 it is released in a known manner and drops then through the duct 30 into the return delivery duct 90.

A large coin recognized as good generates a signal of defined duration in the measuring and evaluating circuit 41, the signal energizing a releasing or unlocking electromagnet 100 by way of a lead 101. The armature 102 thereof moves against the force of a spring out of the pivot path of the sorting weigher 10 and no longer impedes the blocking pin 103 of the sorting weigher. Consequently, the sorting weigher can swing a coin of the defined magnitude into the sorting duct 70. The excitation period for the magnet 100 is so dimensioned that the sorting weigher can swing unimpeded to and fro, whereupon it is locked again by the de-energized electromagnet 100. The sorted coin can then excite the inductive coil 110 which is excited by means of a lead 300 and delivers at its output 120 a counting pulse or the like. A corresponding switch may also be arranged at a greater distance from the unlocking electromagnet 100.

A good coin of smaller diameter effects the same course of operations by way of the sorting weigher 20 with blocking pin 203, unlocking electromagnet 200 with armature 202 and coil 210.

A coin of larger diameter recognized as good is sorted into the sorting duct 70 only if its diameter corresponds to the expected diameter. If it has a smaller diameter, it will drop through as far as the sorting weigher 20 and be blocked there, since the latter does not receive a control signal from the circuit 41. If it is too large, it will not be able to travel into the duct 70, because of the corresponding dimension thereof, and will remain stopped at the entrance to the sorting duct 70. In both cases this prevents acceptance of the undesirable coin, and the generation of a counting pulse.

Figure 2A:
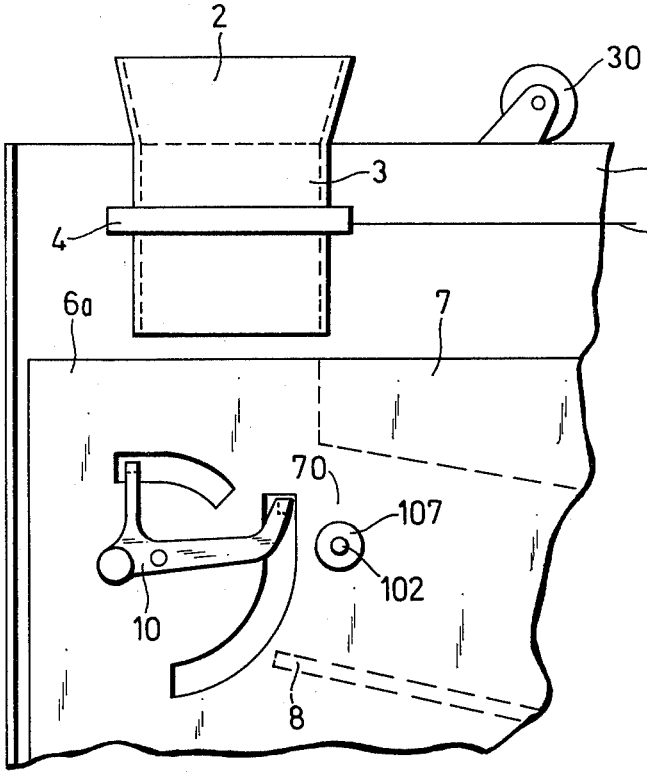
Figure 2B:
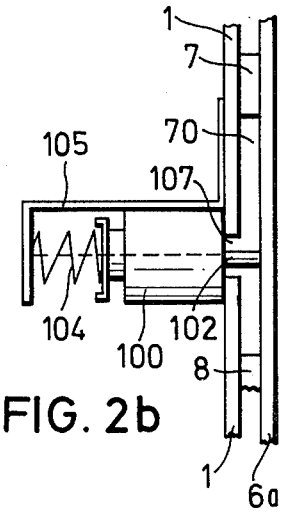

FIGS. 2*a* and 2*b* illustrate a coin testing apparatus of the same kind, but with a differently constructed sorting section. In this example, the sorting weigher 10 of known construction is left unchanged, but is combined with the release electromagnet 100 in a manner such that in the normal or rest position the armature 102 thereof extends through an aperture 107 into the sorting duct 70 and blocks the latter. Upon energization through the lead 101 (FIG. 1) the electromagnet 100 attached to the base plate 1 on the rear face thereof displaces its armature 102 against the force of a spring 104 fixed on a support 105 to such an extent that the sorting duct 70 is released. Thus, depending upon the position of the armature 102 the path into the sorting duct 70 is, or is not released for a coin to be sorted.

Figure 3A:
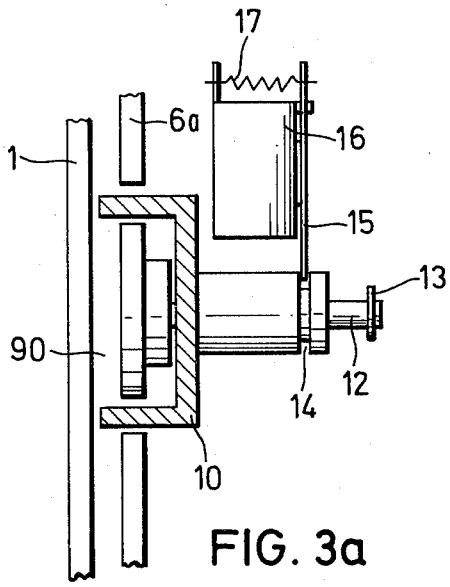
Figure 3B:
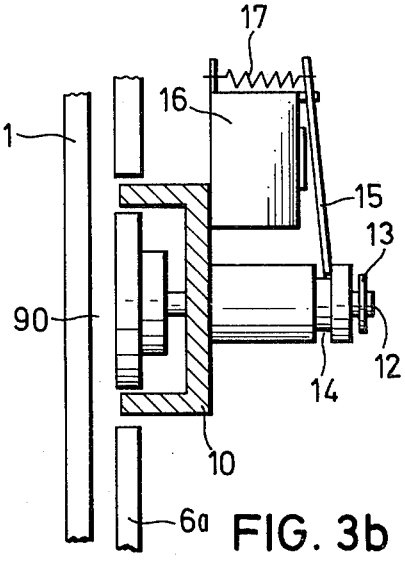

FIGS. 3*a* and 3*b* illustrate a sorting weigher 10 of known construction which has been modified in accordance with the invention and which is displaceably arranged on a shaft 12. The sorting weigher which is located outside the duct 90 in the basic position (FIG. 3*b*) is, when energized, moved into the operative position by the adjuster electromagnet 16 by means of the flap armature 15 thereof. The leading edge of the flap armature 15 engages in a corresponding groove 14 of the sorting weigher 10 which has so much clearance that the pivot movement of the sorting weigher is not inhibited. Upon termination of the controlling energization of the electromagnet 16 the return spring 17 thereof effects the displacement of the sorting weigher 10 into its starting position which may be determined by a limit member 13. The return force of the spring 17 is so dimensioned that even a coin which may possibly be jammed in the interceptor ends of the sorting weigher can be freed during the return pivot movement.

It is to be pointed out that sorting weighers of different construction have also become known, e.g., one-armed ones.

Sorting devices of this construction also may be used for the construction of a coin testing apparatus according to the invention.

Furthermore, sorting devices have become known which effect an examination of the diameter and/or the thickness of a coin and sort it out of a substantially vertical drop duct by means of a sorter bar. Such devices, too, may be constructed controllable in accordance with the invention, as shown by the following example.

Figure 4:
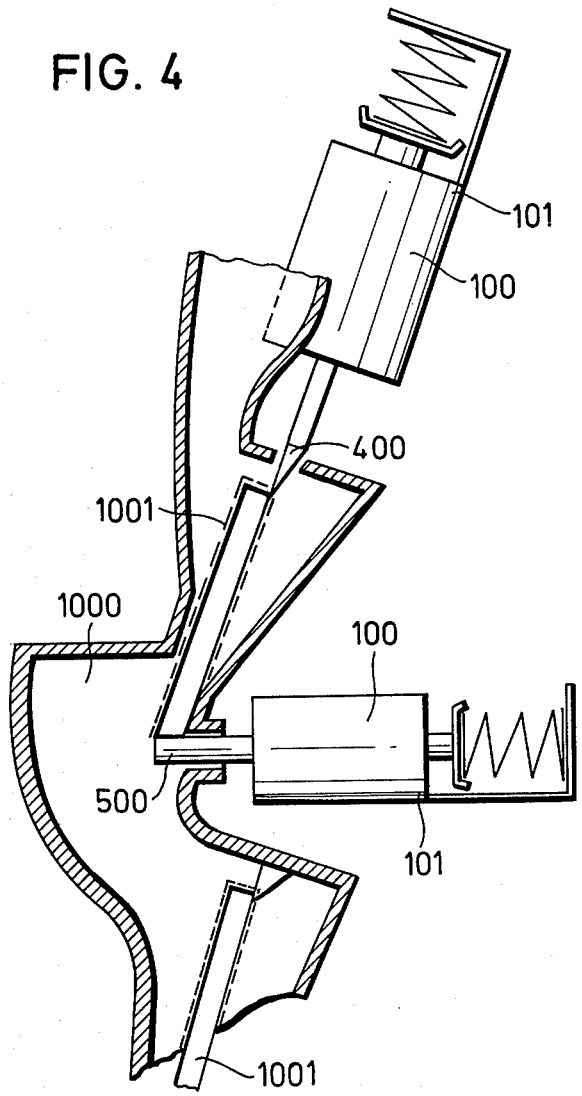
FIG. 4 is a fragmentary elevational view, taken partially in vertical cross section, illustrating a drop duct having a zig-zag shaped course.

FIG. 4 illustrates a drop duct 1000 which has a zigzag shaped course and which is so constructed that—starting with the largest coin—each stage intercepts a coin of a certain diameter and guides it away laterally, whereas coins the diameters of which are too small drop through to the next following stage.

When a "good" coin reaches the stage corresponding to its diameter, the bottom of the coin impinges on a sorter bar 500 while the top of the coin rests against the tip of a support element 400, whereupon the coin rolls away laterally through the corresponding sorting duct 1001. If the coin were smaller in diameter, it would miss the support element 400 and tip over under gravity so as to slide over the end of the sorter bar 500. If the coin were larger in diameter, it could not get through the sorting duct 1001. If the coin, although being the right size, has "failed" the electronic test before reaching the drop duct 1000, the sorter bar 500 and/or the support element 400 will be in an inoperative "rest" position, withdrawn into the respective electromagnet 100, due to non-energization of the electromagnet. Just as in the arrangement described in FIG. 3, such an arrangement has the advantage that all coins which are not recognized as good fall back at once into the money return and need not be unlocked first by means of an unlocking lever 30. In this case also, only a single sorting means is released for a certain period of time, i.e., moved into the operative position, in accordance with the electronic test result.

Even when the sorter bar or the like is located in the operative position it is ensured that coins which are too small fall back into the return and that coins which are too large cannot travel into the sorting duct. Thus in this construction also, the solution according to the invention ensures that only coins can be sorted whose dimensions are in agreement with the electronic test result obtained.

One of the constructional forms described above comprises a sorting section which consists of the combination of a sorting weigher or sorter bar and a controllable blocking element. The blocking element blocks the entry to a sorting shaft and releases the same only for a coin found to be good and only for a certain period of time.

This construction has the disadvantage that admittedly a false coin is stopped, but the entry is released for this false coin when a subsequently following good coin effects again the temporary opening of the entry.

In principle this disadvantage may be avoided by means of suitable measures in the circuitry. However, this problem can be solved in a simple mechanical manner by a suitable construction of the blocking element.

According to a feature of preferred embodiments, a coin testing apparatus with a guide duct for coins and an electronic measuring and evaluating circuit monitoring the latter and producing an output signal of defined duration which is characteristic for the type of each coin recognized as good, and a sorting device which is arranged underneath the guide duct and examines the dimensions of the coin and which comprises the combination of a sorting weigher or a sorter bar and a controllable blocking element is therefore characterized in that the blocking element (lever, slider member or the like) comprises at its leading end at least one formation (projection or notch) directed against the travelling direction of the coins and in the blocking position this leading end thereof is so located in a corresponding depression of a wall of the sorting duct that a coin arrested by the blocking element may locate itself in front of or in the formation and prevent an opening movement of the blocking element. In the simplest form the formation consists of the end bent at right angles against the travelling direction of the coins, of a slider member or the like. The arrested coin is blocked by the slider member. Energization of the blocking element does not lead to release of the sorting duct, because the coin in turn blocks the opening movement of the slider member.

However, even this improved construction has the disadvantage still that every bad coin—after it has been stopped—must be removed by actuation of a release key. This is not a functional defect, but it is not an optimum facilitation of operation.

It is more advantageous to construct a coin tester in such a manner that false coins are not stopped, but are guided automatically to the money return without the need for the use of a release key.

Some constructions of this kind have already been described above. A further constructional possibility with optimum comfort of operation is proposed in accordance with the invention.

According to a feature of preferred embodiments of the invention a coin testing apparatus with an electronic measuring and evaluating circuit monitoring a guide duct for coins, which circuit produces an output signal which is characteristic for the type of each coin recognized as good and has a defined duration, and which is combined with a sorting device disposed underneath the guide duct and monitoring the dimensions of the coins, the sorting device comprising a controllable sorting section for each desired type of coin and the individual sorting sections thereof being rendered ready for operation by means of the appropriate type-characterizing output signals of the measuring and evaluating circuit for a period of time of such length that a coin recognized by the measuring and evaluating device can travel through the sorting section prepared for it within this period of time with normal unimpeded forward movement, is characterized in that a sorting section consists of the combination of a sorting weigher or a sorter bar and a controllable slider member or the like, and that the slider member or the like, when in the unenergized state, is located outside the corresponding sorting duct, and when in the controlled or operated state forms for a certain distance the bottom or a lateral limitation of the leading portion of the respective sorting duct and thus permits coins to be accepted to travel into the rearward portion of the sorting duct and prevents dropping out of the sorting duct, but allows a coin to drop out of the sorting duct when in the basic, rest or inoperative condition.

A further preferred feature of the invention resides in constructing the coin tester for four or more types. It must first be stated that most coin testers are internationally normed in respect of height and width and that therefore it is impossible to arrange an unlimited number of sorting ducts branching off laterally, at locations one below the other. Within the given dimensions a maximum of three sorting sections can be disposed underneath the electronically monitored guide duct. It is therefore proposed according to the invention to construct at least one of these sorting sections in such a manner that it can accommodate two or more differently sized kinds of coins. According to the invention such a sorting section will comprise at its downstream end, that is to say at the rear end of the sorting duct, sorting devices of any desired kind for sorting the arriving coins and will be constructed for multiple functioning in its leading section. According to the proposals of the invention the one wall of the drop duct for coins comprises in the respective sorting section a sorting weigher which examines the largest one of a plurality of coins in respect of its dimensions and swings it into the sorting duct. At its other wall the drop duct comprises a controllable slider member or the like which, in case another one of the desired types of coins is recognized, is controlled in the manner of a wiper by the electronic measuring and evaluating circuit, enters thereby into the drop duct through an appropriate recess in the side wall and guides the coin to be accepted into the sorting duct.

Figure 5:
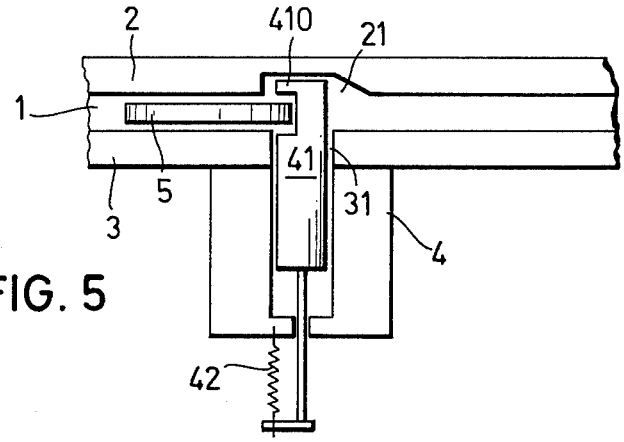
FIG. 5 is a fragmentary top plan view illustrating a modified blocking element constructed in accordance with the present invention.

FIG. 5 shows a sorting duct 1, having two side walls 2 and 3. The armature 41 of an electromagnet 4 is moved by a spring 42 into the recess 21 of the wall 2. In this position the armature 41 retains a coin 5 not to be accepted. Upon energization of the magnet 4 the armature 41 cannot move away out of the sorting duct into an aperture 31 in the wall 3 because the end 410 bent away at right angles is blocked by the coin 5. Good coins of the same dimensions cannot travel into this sorting duct until the false coin 5 has been removed from its position by means of an unlocking device.

Figure 6:
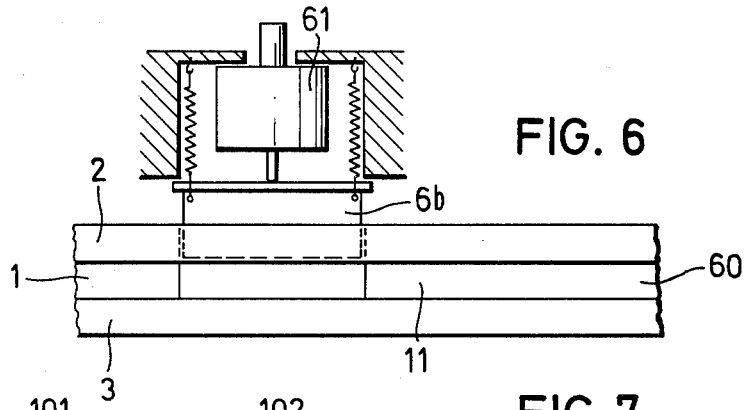
FIG. 6 is a fragmentary plan view, taken partially in horizontal cross section, illustrating another embodiment of a controllable slider member.

In FIG. 6 the sorting duct is denoted by 1, its two side walls by 2 and 3. In the leading portion its bottom is formed by a slider member **6*b* which is located outside the sorting duct in the blocking position. If a coin is to be accepted, the slider member 6b is displaced by the electromagnet 61 into the sorting duct 1 against the force of a spring and permits a coin to travel within a period of time predetermined by the measuring and evaluating device not illustrated into the rearward portion 11 of the sorting duct with a stationary bottom 60. In this sense the slider member may alternatively form for a certain distance the lateral limitation of a laterally inclined sorting duct and in the basic position may permit the coin to tip away laterally, in the acceptance position to travel through into the rearward portion 11** of the sorting duct. Also any other kind of two way-guidance of a coin by known means of the art may be envisaged.

Figure 7:
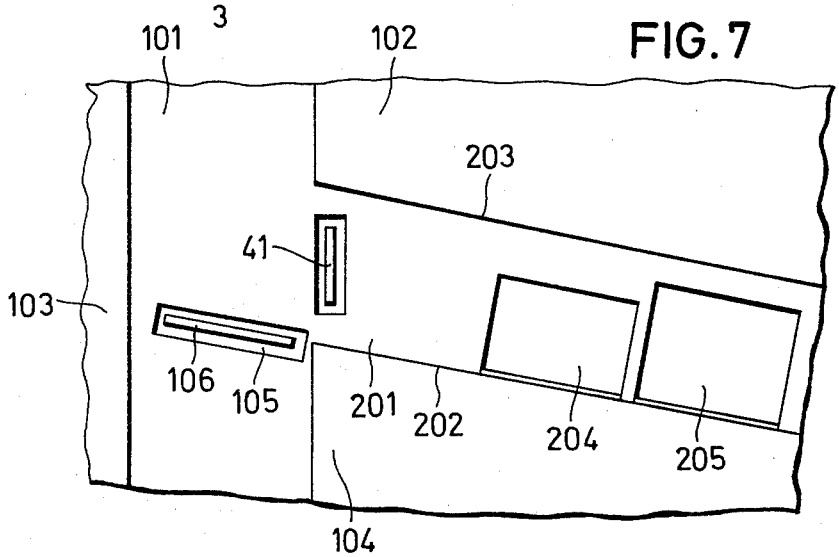
FIG. 7 is a fragmentary elevational view illustrating a sorting duct for different sized coins.

In FIG. 7 the one wall of a vertical drop duct 101 having corresponding boundaries 102, 103, and 104 is illustrated as well as a sorting duct 201 branching off laterally and having a bottom 202 and an upper boundary 203. In its back region the wall of the sorting duct 201 comprises two apertures 204 and 205 into which the coins may tilt away in accordance with their size—owing to the corresponding inclination of the wall of the sorting duct—and may travel to separate outlets.

According to the invention, a sorting weigher of known construction is arranged at the other wall, not illustrated, of the drop duct; it grips the largest coin provided and swings it into the sorting duct with examination of its dimensions. This coin type will travel as far as the aperture 205 and will be sorted therein.

If the measuring and evaluating circuit detects a good coin to be accepted of another type of smaller diameter—or under circumstances even a coin of two or more types to be accepted of smaller diameter—the slider member 106 which rests in a slot 105 in the wall 101 is displaced into the drop duct for the necessary period of time by an electromagnet not illustrated, and thereby it will deflect the arriving coin laterally into the sorting duct 201 and permit it to continue to travel as far as the aperture 204.

In accordance with the proposals of the invention, the measuring and evaluating circuit, upon each measurement of a good coin to be accepted—that is to say independently of the different diameters—will always displace also the blocking element 41 out of the sorting duct 201 for a certain period of time.

This arrangement ensures that the respective good coins of two or more types of coins to be accepted are accepted, namely the largest type by means of the sorting weigher and the blocking element displaced to the release position, the other type (or the other types) by means of the slider member 106 displaced to the acceptance position and the blocking element 41 displaced to the release position.

A false coin having the diameter of the largest coin type is admittedly likewise engaged by the sorting weigher, but is blocked by the blocking element 41 which has remained in the blocking position. A false coin of smaller diameter will not be engaged by the sorting weigher, nor by the slide member 106 which has not been energized, and will fall down through the drop duct 101 to the money return.

It would be a fundamental defect of the solution described so far if no notice would be taken that for the examination an electronic coin tester according to this invention, a good coin needs a certain period of time from the instant of its detection to the complete entry into the sorting section prepared for it.

When coins enter in quick succession, malfunctionings may therefore occur; e.g., a bad coin which precedes immediately a good coin may proceed to acceptance, because it reaches the sorting section opened by the good coin even ahead of the latter.

Therefore it is a feature of preferred embodiments of the invention to prevent such malfunctionings and others, and proposes below suitable new measures:

More particularly, in preferred embodiments of the invention the coin testing apparatus is provided with a switch or the like, as well as a timing stage controlled by the latter.

The switch may be of any desired construction. It may involve a mechanical or electrical switch actuable by the coin, an inductively or photoelectrically operating switch, or a level-monitoring threshold switch connected to the measuring and evaluating circuit. The timing stage, too, may be of any desired construction, for example as a timing stage with finite period, or as a separately re-set flip-flop or the like. This timing stage is given the task to prevent the measurement of further objects or the control of sorting sections during a defined period of time.

This fundamental solution may be performed in various ways, as will be shown with reference to the following examples:

According to one feature of preferred embodiments of the invention the switch may be so arranged that it is not actuated by the coins to be monitored until after a measurement output has been produced, or the start of a timing stage has been effected for the control of a sorting section, respectively.

In this case the choice is available to suppress any further measurement of coin acceptance for a certain period of time after each measurement, or to effect this only when a measurement output yielded a "not good" measurement result.

Therefore, a preferred embodiment of the invention may be characterized in that after the generation of the measurement result of the actual control of a sorting section, the switch starts the control timing stage connected to it, that the period thereof corresponds to at least the normal travelling through-period of a coin from the switch to the adjuster element of a sorting section, and that the controlling energization of the control timing stage by the switch becomes effective only if a good measurement result is not present or an energization of a sorting section is not present, respectively. This may be obtained for example in a known manner in accordance with the rules of the art by logic linkage of the switch signal and the output signal of one or more timing stages for the controlling energization of sorting sections.

If one proceeds in this manner, a good coin immediately following a bad coin does not effect opening of the respective sorting section, because the control timing stage used in accordance with the invention introduces an enforced pause after the measurement of the bad coin. The advantage of this solution on the other hand is that a high acceptance rate is maintained for a multiplicity of successively inserted good coins, because in the case of detection of a good coin this enforced pause is not effected by the control timing stage.

However, this solution which at first sight is optimal, can still be outwitted by certain fraudulent maneuvers. It is therefore safer to proceed in accordance with another feature of preferred embodiments of the invention in such a manner that—independently of the fact whether the measurement result was good or bad—a compulsory pause is inserted after each measurement. Admittedly, the acceptance rate for good coins drops slightly thereby, but the protection against fraudulent manoeuvres is increased.

According to another feature of preferred embodiments of the invention any desired switch may even be arranged in such a manner that it controls the control timing stage associated therewith even before the generation of a measurement output. This is possible for example when this stage in turn controls a mechanically operating electrically actuable device which prevents the entry of further coins into the measuring probe or the like at least for so long that with normal advance the measured coin must have arrived in the sorting section. Such a controlled device may consist of a lever or the like which blocks the guide duct for coins ahead (upstream) of the measuring probe. Another solution by way of example consists in a displaceable bottom member of the guide duct which forces coins which arrive during the control period, to drop through into a money return.

A further particularly advantageous solution is constituted by utilization of the control timing stage for delaying the activation for a sorting section and to dimension the activation delay to such an extent that the acceptance position of the sorting section is not attained until immediately before the arrival of the coin intended for it.

Many further possible solutions may be envisaged with the means of the art, in which the control timing stage wholly or partly temporarily switches off or suppresses the measuring and evaluating circuit or the control of sorting sections, in accordance with the invention.

Figure 8:
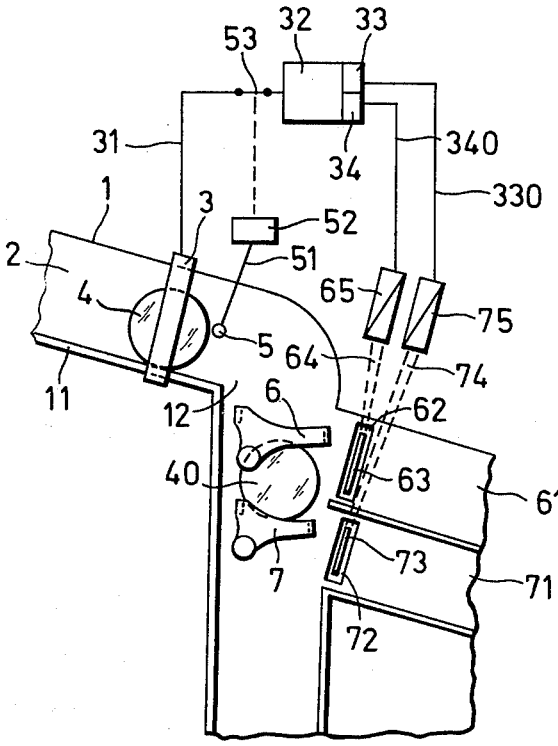
FIG. 8 is a fragmentary elevational view, partially schematic, illustrating means for introducing a time delay before the measurement of a new coin.

The following examples illustrate a few possible constructions of the inventive ideas:

In FIG. 8 a guide path for coins is denoted by 2, its bottom by 11, and a subsequent drop duct by 12. 1 denotes the upper limitation of the guide path. A coin 4 is located in the position in which it has produced a measurement output by the measuring probe 3—which is connected to a measuring and evaluating circuit 32 by means of a lead 31. If this output is "good," either a timing stage 33 or a timing stage 34 is activated, dependent upon the coin type; the timing stages are connected by leads 330 and 340 respectively to electromagnets 65 and 75. Upon activation the flap armatures (64 and 74 respectively) thereof, illustrated by broken lines, move to such an extent that the angled leading ends thereof (63 and 73 respectively) move away from the sorting tracks (61 and 71 respectively) blocked by them and release them temporarily. The armature ends 63 and 73 respectively, inserted in the respective apertures 62 and 72 thus permit an arriving coin, provided it has passed the respective sorting weigher (6 or 7) arranged upstream thereof, to enter into the sorting track (61 or 71 respectively), and after the entry of the coin may close immediately the respective sorting track dependently upon the period of time determined by the timing stage 33 or 34, respectively. A switch 5 prevents a bad coin 40 preceding the good coin 4 from being accepted even if the coin 40 has the correct dimensions necessary for overcoming the sorting weigher 7. This is achieved in that the switch 5 is actuated by all coins passing by, that is to say also by the bad coin 40.

A timing stage (control timing stage) 52 is started by way of a lead 51 upon actuation of the switch 5. Its timing period corresponds to the normal travelling period corresponds to the normal travelling period of a coin from the instant of actuation until the coin arrives in front of the blocking element 73 which may be so constructed that a coin resting in front of it has a self-blocking effect therefor. At this instant of time a renewed control of the sorting section thus would not lead any more to the release of the false coin. However, during the period of the control timing stage 52 the latter interrupts the connection between the measuring probe 3 and the measuring and evaluating circuit 32 by means of the contact 53 associated with it, so that energization (i.e., control) of the electromagnet 65 or 75 cannot be effected by a subsequent good coin. The correct coin 4, not measured, is therefore likewise regarded to be false and stopped in front of the closed sorting duct 71. It may be removed thereafter in a known manner by means of an unlocking device not illustrated. The described arrangement ensures simultaneously also a minimum time spacing between two good coins following each other. When the succession is too close, only the first one is accepted; the second one is blocked. This has the advantage that switches disposed for example below the sorting shaft 71 for counting the coins switch in every case with sufficient spacing in time, and not in an overlapping manner.

Figure 9:
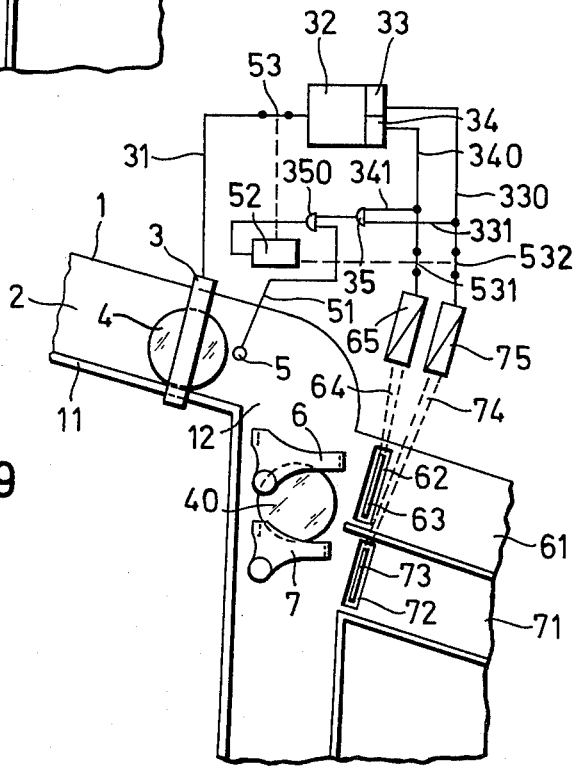
FIG. 9 is a fragmentary elevational view, partially schematic, illustrating another embodiment of a time delay means after encountering a non-genuine coin.

FIG. 9 illustrates a similar device as described in FIG. 8. The same reference numerals are used. The control leads 330 and 340 for the electromagnets 65 and 75 comprise branches 331 and 341 which lead to an OR gate 35. The output thereof and the lead 51 are so connected in an exclusive OR gate 350 that energization (i.e., control) of the timing stage 52 does not occur when a signal prevails at the output of gate 35. Only when a new coin has been detected to be false, that is to say when neither the lead 331 nor 341 carries a signal and thus the gate 35 also carries no signal, can the timing stage 52 start and prevent a further acceptance for a defined period of time. This may be effected by means of the contact 53 which interrupts the connection between the measuring probe 3 and the measuring and evaluating circuit 32 or alternatively—merely by way of example—by means of the contacts 531 and 532 which interrupt the feed of the electromagnets 65 and 75.

Figure 10:
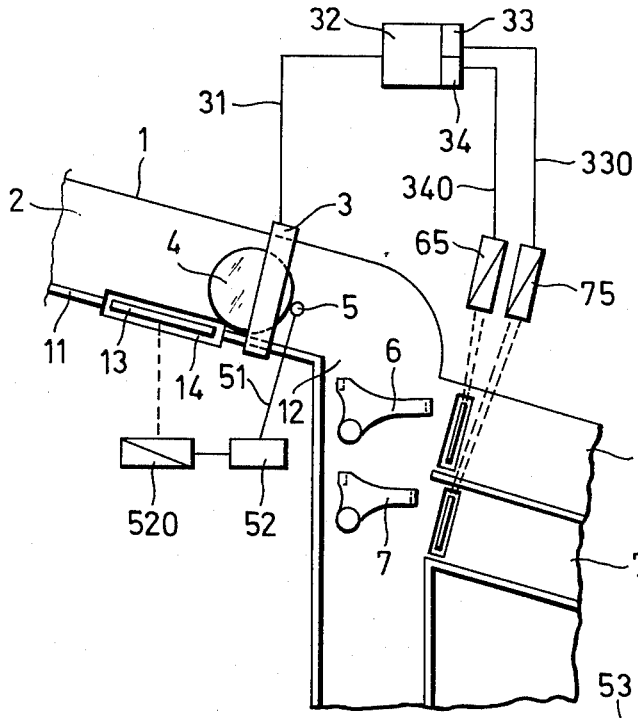
FIG. 10 is a fragmentary elevational view, partially schematic, illustrating a modified form of time delay means.

Using the same reference numerals, FIG. 10 describes a further variant of the invention. The fixed bottom 11 of the coin guide track 2 is constructed for a certain distance in its leading portion in the form of a displaceable slider member 13 which is pulled into the wall aperture 14 by an electromagnet (520) not illustrated upon energization thereof by way of the control timing stage 52. When a coin 4 actuates the switch 5, this movement is performed and all immediately following coins are prevented from entering the measuring probe 3. Within a period of time predetermined by the control timing stage 52 all following coins fall down into the money return. A further measurement of coins does not become possible until after expiry of this period.

Figure 11:
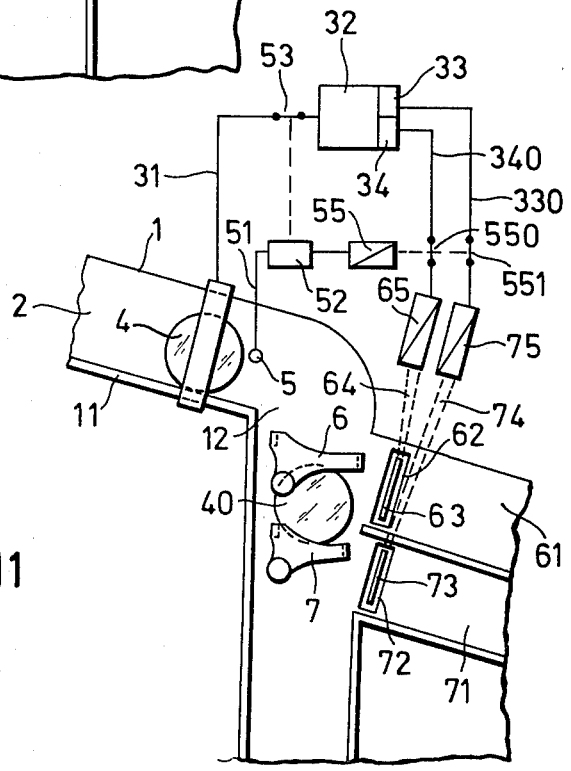
FIG. 11 is another embodiment using a relay.

FIG. 11 describes a further form of the invention. Using the same references as in the preceding FIGS. 8 to 10 a control timing stage 52 is illustrated which controls a relay 55; the contacts 550 and 551 of the latter interrupt the control leads 330 and 340 to the electromagnets 65 and 75. Thus in spite of control by a timing stage (33, 34) an electromagnet cannot be energized as long as prescribed by the period of the control timing stage 52. The period of the latter is so dimensioned that it corresponds to the travelling time of a coin from the switch 5 to a blocking element (73 or 63) minus the attraction time of the flap armatures (64, 74). In consequence thereof the entry into a sorting duct is not opened until immediately prior to the arrival of the respective coin which has effected the opening by way of the measuring and evaluating circuit 32 owing to a good measurement signal. It may be seen from the example illustrated that a bad coin 40 preceding the good coin 4 is not accepted, because it arrives already in front of the blocking element (73) of self-blocking construction before the latter can open. Thus the bad coin 40 stopped, and likewise the good coin 4 following thereafter.

I claim:

1. Coin testing apparatus for plural denominations of coins, characterized by the combination of a. an electronic measuring and evaluating circuit monitoring a guide duct for coins,
   (1) said circuit producing an output signal of defined duration and characteristic for a recognized genuine coin, b. and a mechanically operating sorting device for distinguishing between genuine and nongenuine coins on the basis of an examination of the physical dimensions of the coins,
   (1) one of said mechanically operating sorting devices being provided for each denomination of coin being accepted by said coin testing apparatus,
   (2) said mechanically operating sorting devices being selectively energized electrically to perform its sorting function by the output of said electronic measuring and evaluating circuit on the basis of the denomination of coin recognized by said circuit.

2. Coin testing apparatus according to claim 1 wherein coins proceed by gravity flow from one testing position to the next and said apparatus includes a gravity flow duct beyond said mechanically operating sorting device having inductive means associated therewith for producing counting pulses.

3. Coin testing apparatus according to claim 1 wherein said mechanically operating sorting device includes a pivotal member positioned in the normal flow of coins to provide a measurement of the diameter of the coins, said pivotal member catching coins of one diameter and upon pivotal movement thereon delivering said coin to a gravity flow duct, but said pivotal member passing coins of a smaller diameter.

4. Coin testing apparatus according to claim 3 including means electrically controlled by the output of said electronic measuring and evaluating circuit for preventing pivotal movement of said pivotal member.

5. Coin testing apparatus according to claim 1 wherein said mechanically operating sorting device is normally positioned externally of the path taken by a coin to be tested but is movable into a coin testing position by an output signal of said electronic measuring and evaluating circuit by energization of an electromagnet.

6. Coin testing apparatus according to claim 1 wherein said mechanically operating sorting device includes means insertable into the path of travel of a coin to be tested to engage a leading edge of the coin to be tested and an auxiliary means engageable with a trailing edge of the coin to be tested to align the edges of said coin with a gravity flow duct.

7. Coin testing apparatus according to claim 1 including switch means actuated by a coin to be tested for introducing a time delay to prevent reactivation of said electronic measuring and evaluating circuit and thereby no selective reenergization of said mechanically operating sorting devices until said coin which actuated said switch means has been tested.

8. Coin testing apparatus according to claim 7 wherein said switch means is so arranged that it cannot reintroduce a time delay until said electronic measuring and evaluating circuit has produced an output signal.

9. Coin testing apparatus according to claim 7 wherein said time delay introduced by the detection of a coin by said switch means is of a predetermined length of time such that said selectively energized mechanically operating sorting device is energized by the output of said electronic measuring and evaluating circuit immediately prior to the arrival of the coin at said sorting device.

* * * * *